US006729436B1

(12) United States Patent
Yeh

(10) Patent No.: US 6,729,436 B1
(45) Date of Patent: May 4, 2004

(54) SAFETY DEVICE FOR PYLON

(76) Inventor: Chi-Hsang Yeh, 2nd Floor, No. 123, Huan-San Road, Section 2, Taipei (TW)

( * ) Notice: Subject to any disclaimer, the term of this patent is extended or adjusted under 35 U.S.C. 154(b) by 0 days.

(21) Appl. No.: 10/364,425

(22) Filed: Feb. 12, 2003

(51) Int. Cl.[7] ..... E04G 3/14
(52) U.S. Cl. ..... 182/36; 182/3
(58) Field of Search ..... 182/36, 3, 8, 9, 182/45; 104/93, 111; 248/72, 220.21, 237, 228; 52/698, 148, 152

(56) References Cited

U.S. PATENT DOCUMENTS 4,052,028 A * 10/1977 Cordero, Jr. ..... 182/3
4,606,430 A * 8/1986 Roby et al. ..... 182/3
4,767,091 A * 8/1988 Cuny ..... 182/3
6,056,085 A * 5/2000 Cutter et al. ..... 182/36
6,092,623 A * 7/2000 Collavino ..... 182/3
6,148,580 A * 11/2000 Weir ..... 182/3
6,298,629 B1 * 10/2001 Ador ..... 182/3
6,425,458 B1 * 7/2002 Soll ..... 182/36
6,547,033 B1 * 4/2003 Cheval ..... 182/3
6,571,912 B2 * 6/2003 Soll ..... 182/36

* cited by examiner

*Primary Examiner*—Hugh B. Thompson, II
(74) *Attorney, Agent, or Firm*—Dykema Gossett PLLC

(57) ABSTRACT

A safety device for a pylon includes an upper frame connected together with a lower frame, wherein both the upper frame and the lower frame includes two parallel steel pillars. fixedly connected together by a thick steel piece, the upper frame and the lower frame are connected through two parallel connecting rods to enable the upper frame and the lower frame to make relative motion. Two oblique safety grooves are respectively mounted on an inner side of the steel pillars and used for telescoping with specific-designed H-shaped safety rail. A connecting ring is mounted on the rear end of the safety device for providing the safety device to connect and slide with human body. In case of accident, the instantaneous force generated between the safety groove and the safety rail can stop the human body from falling and achieve the safeguard function.

1 Claim, 5 Drawing Sheets

SAFETY DEVICE FOR PYLON

TECHNICAL BACKGROUND OF THE INVENTION

Currently, electric power is the main stream of the available energy source in the world. In general, electric power is conveyed by power lines. Normally, the pylon that is used to set up the power lines to convey electric power is tens of meters in height. The workingman who works on the pylon is bound to expose himself to a high risk. Therefore, the workingman who works on the pylon is fastened with a safety belt to avoid an accident. However, the safety belt should not be too long, and a long safety belt is indicative of low security. Furthermore, in order to allow the workingman to shift around by the safety belt, one end of the safety belt must be tied to a safety device that can be slid with a human body. Typically, a safety device is telescoped into a safety rail designed for a specific purpose and can be slid in a forward direction only. If it is desirable to enable the safety device to be rapidly slid in a backward direction, brake action will occur immediately to stop the safety device from sliding and the safeguard function i.s achieved accordingly. The construction of conventional safety device for pylon is illustrated as follows.

FIG. 1 schematically shows a pylon under construction. It can be seen from FIG. 1 that a safety rail (2) is annexed to the main frame of the pylon (1). Rail switches (21) that are capable of turning the safety rail (2) with 90 degrees are respectively mounted at each intersections of the transverse braces (11), so as to connect with the safety rail on the transverse braces (11). After the safety device (3) is telescoped into the lower end of the safety rail (2), it will be shifted up along the safety rail through the connection with the safety belt together with the climbing of the workingman. If the safety device (3) is shifted to the location of the rail switch (21) and intends to move along the brace (11) horizontally, the rail switch (21) must be turned left or right with 90 degrees, and the safety device (3) may be transferred to the safety tail on the transverse bracing (11) to proceed with horizontal sliding.

FIG. 2 shows four side views of the conventional safety device for pylon, wherein FIG. 2-1 is a front view, FIG. 2-2 is a top view, FIG. 2-3 is a bottom view and FIG. 2-4 is a right-side view of the conventional safety device. FIG. 3 is a cross-sectional view taken along line A—A of FIG. 2-2. It can be seen from FIGS. 2 and 3 that the safety device is a frame-like structure including an upper frame and a lower frame that are adjustably connected together, wherein the upper frame is made of two parallel upper short steel pillars (4) that are fixedly connected together by a thick steel piece (41) and the lower frame is made of two parallel lower short steel pillars (5) that are fixedly connected together by a thick steel piece (51). The upper frame and the lower frame are adjustably connected through two parallel connecting rods **(6*a*,6*b*) that are adjustably connected through transverse axles (61). Safety grooves (42,52) are respectively mounted on the inner side at the right end of the short steel pillars (4,5), and rollers (43, 53) are respectively mounted on the inside of the slit of the upper safety groove (42) and the outside of the slit of the lower safety groove (52). A connecting ring (33). is mounted on the left end of the lower frame where the safety belt (31)** is connected thereto.

FIG. 4 shows a front view and a sectional view of the safety rail (2) according to the prior art, which is shown in the shape of an inverted letter "H" lying transversely and has a wider rail base (22) and a narrower rail shoulder (23). A number of perforations (221) are provided on appropriate locations on the rail base (22) for connecting with pylon (1). The safety groove (42,52) of the safety device (3) are telescoped into the rail shoulder (23) to proceed with sliding.

FIG. 5 schematically shows a safety device (3) being telescoped into a rail shoulder (23) to proceed with sliding according to the prior art. The width of the safety groove (42,52) is slightly larger than the thickness of the rail shoulder (23). While the safety belt (31) is pulled up with the workingman (32), it is pressed to contact with the rail shoulder (23) by two connection points within the rollers (43,53) due to leverage action. Therefore the safety device can be slid upwards smoothly without any resistance. However, in case of accident, the safety belt (31) that is fastened with human body will be pulled down, and here the connection points between the safety belt (31) and the rail shoulder (23) will be points (B,C) within the bevels of the two safety grooves (43,53). In this manner, forces will be generated so that a huge resistance is created between the safety device (3) and the rail shoulder (23) to stop the safety device (3) from falling. It is foreseeable that if the safety device is telescoped into the safety rail in an opposite direction, the safety device still can be pulled up due to the small pulling force, slow pulling speed and the little resistance generated between the points (B,C). In case of accident, the safety device will be pressed to contact with the rail shoulder (23) through rollers (43,53) without any resistance, and an immediate danger might occur. This point is indeed a drawback of the conventional safety device for pylon. Consequently, when the safety device for pylon is brought into use, the overseers have to pay enormous attentions to prevent the workingman from careless operation. When the workingman desires to shift to work on the transverse brace (11), the rail switch (21) has to turn right with 90 degrees (or turn left with 90 degrees) so that the safety device (3) can be slid rightward (or leftward) with the pull of the safety belt (31). At this moment the rail shoulder (23) is pressed to contact with rollers (43,53) without resistance. On the contrary, if the workingman shifts in an opposite direction, the points (B,C) are forced to be in contact. Though the pulling speed is slow and the pulling force is not large, the resistance is sufficient to make the safety device uneasy to be pulled. As a result, the workingman has to bend down to push the safety device manually. Nonetheless, it is difficult even impossible for the workingman to bend down frequently due to the environmental limitations of available working space on the brace. Such a difficulty in driving the safety device to slide in an opposite direction is another drawback of the conventional safety device for pylon. While the safety device is sliding in parallel (regardless of leftward sliding or rightward sliding), because the safety groove (42,52) are telescoped with two sides of the rail shoulder (23), it will not fall off from the safety rail at anytime.

SUMMARY OF THE INVENTION

The inventor has been engaged in the projects of pylon construction for years, and has been continuously making contributions to the improvements on the prior art to eliminate the drawbacks encountered by the conventional safety device for pylon. The present invention is attained by attaching an iron foil of great elasticity over the slit of the lower safety groove (52) to effectively prevent the safety device from reverse mounting, and mounting the oblique mobile blots on the steel pillars (5) of the lower frame of the safety device. When the safety device is shifting in parallel, the mobile bolts will automatically prop against the connecting rod to stop the upper frame and the lower frame of the safety device from parallel relative motion, such that the safety device will not meet with any resistance regardless of forward sliding or backward sliding. According to the present invention, the difficulty of the need to force the workingman to bend down frequently to push the safety device as the safety device is shifting in an opposite direction can be overcome, and the function of the safety device can be perfected.

The features and advantages of the present invention will become more apparent through the following descriptions with reference to the accompanying drawings, in which:

BRIEF DESCRIPTION OF THE DRAWINGS

FIG. 2-1 shows the front view of the safety device for pylon according to the prior art.

FIG. 2-2 shows the top view of the safety device for pylon according to the prior art.

FIG. 2-3 shows the bottom view of the safety device for pylon according to the prior art.

FIG. 2-4 shows the right-side view of the safety device for pylon according to the prior art.

FIG. 3 is a cross-sectional view taken along line A—A of FIG. 2-2.

FIG. 4 show a front view and a sectional view of the safety rail according to the prior art.

FIG. 6-1 shows the front view of the safety device for pylon according to the present invention.

FIG. 6-2 shows the right-side view of the safety device for pylon according to the present invention.

FIG. 6-3 shows the bottom view of the safety device for pylon according to the present invention.

FIG. 8-1 shows the front view of the mobile bolt according to the present invention.

FIG. 8-2 shows the right-side view of the mobile bolt according to the present invention.

FIG. 8-3 shows the sectional view of the mobile bolt according to the present invention.

DETAILED DESCRIPTION OF THE PREFERRED EMBODIMENT

Figure 1:
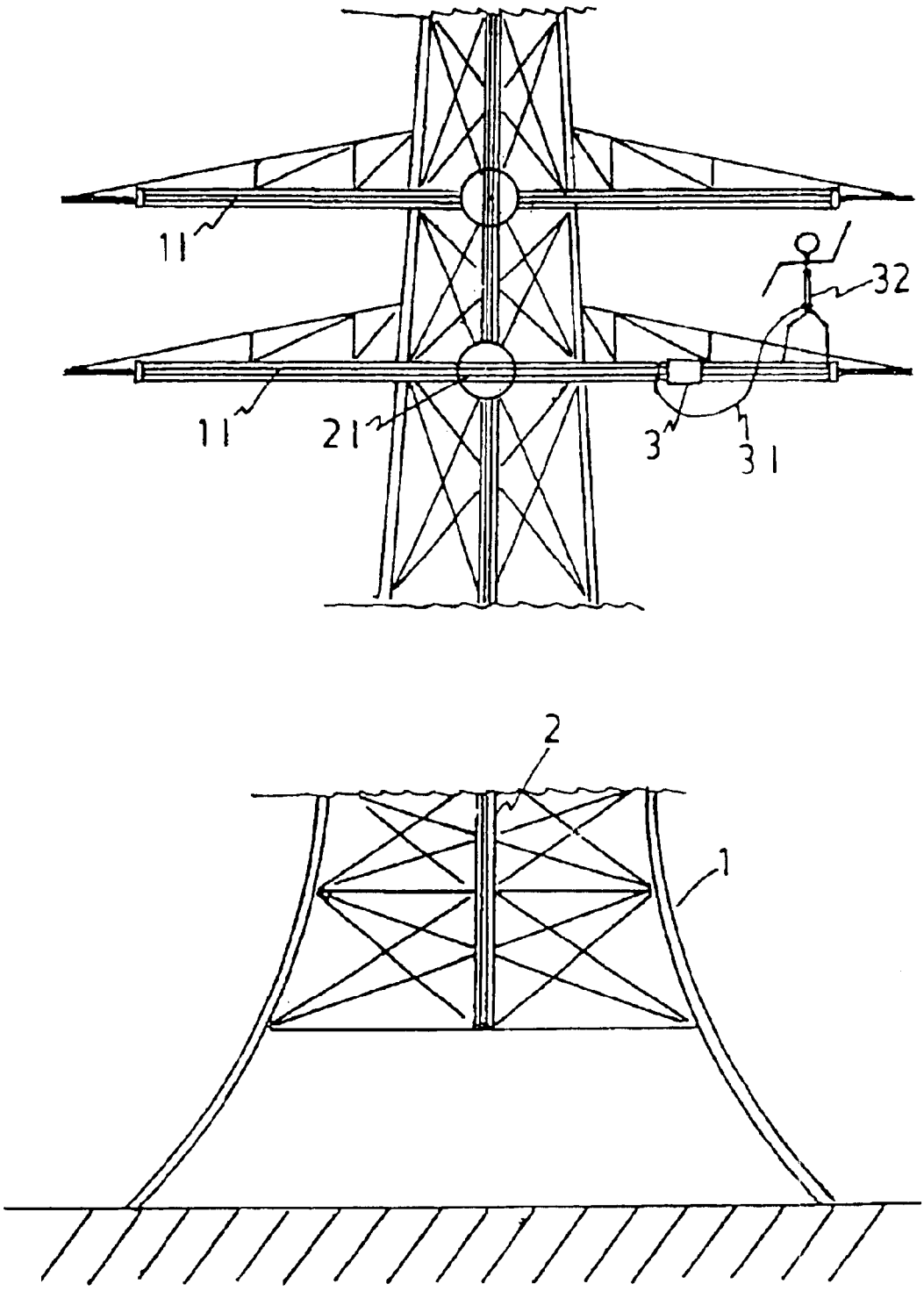
FIG. 1 schematically shows a pylon under construction.
Figure 2:
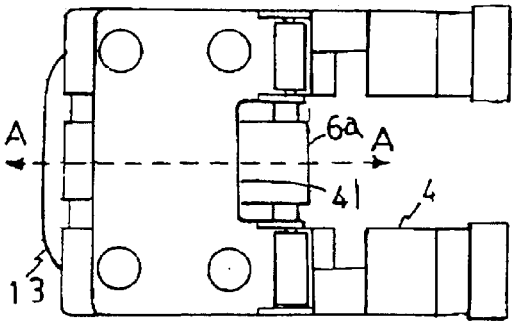
Fig 2-2 (PRIOR ART)
Figures 1, 2:
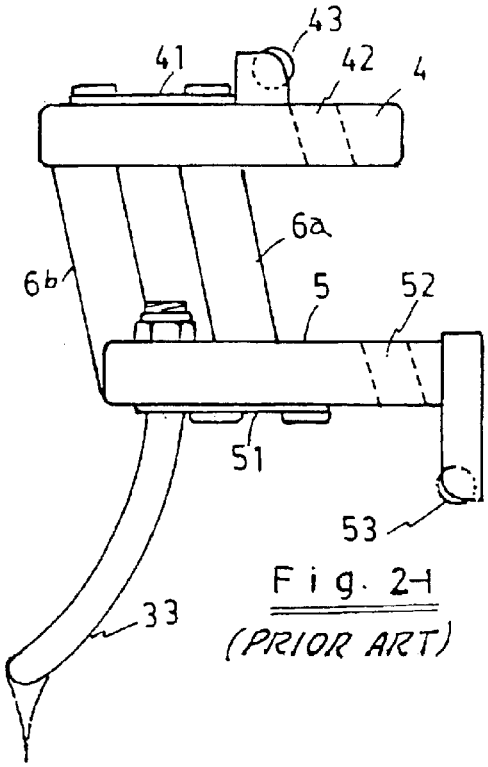
Fig. 2-1 (PRIOR ART)
Figures 2, 3, 4:
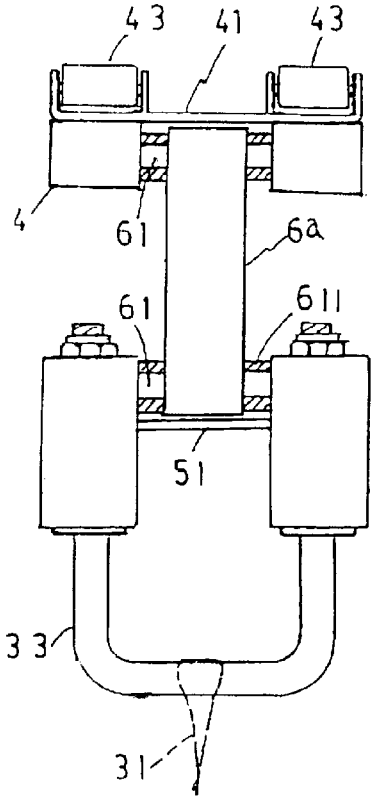
Fig. 2-4 (PRIOR ART)
Figures 2, 3:
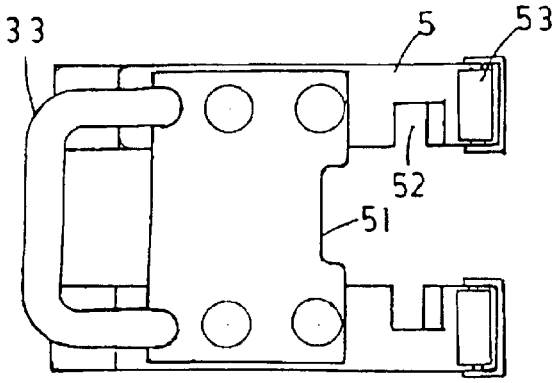
Fig. 2-3 (PRIOR ART)
Figure 4:
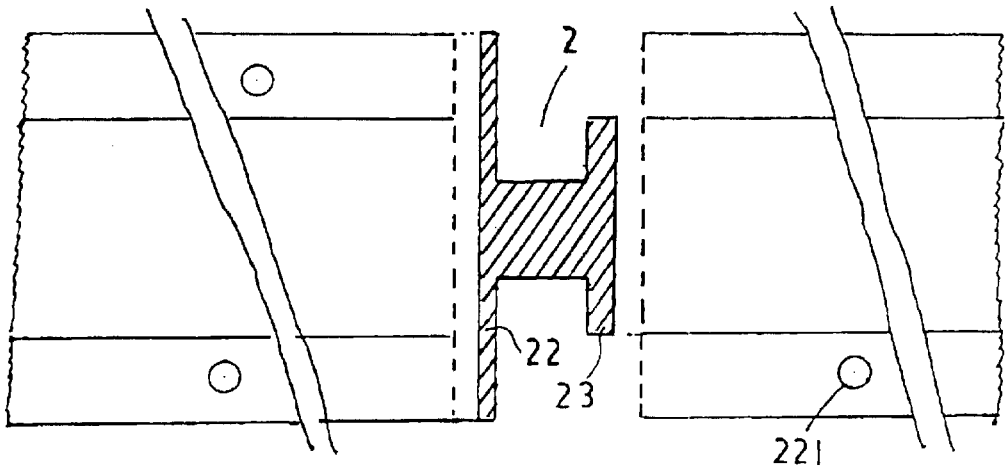
Fig. 4 (PRIOR ART)
Figure 3:
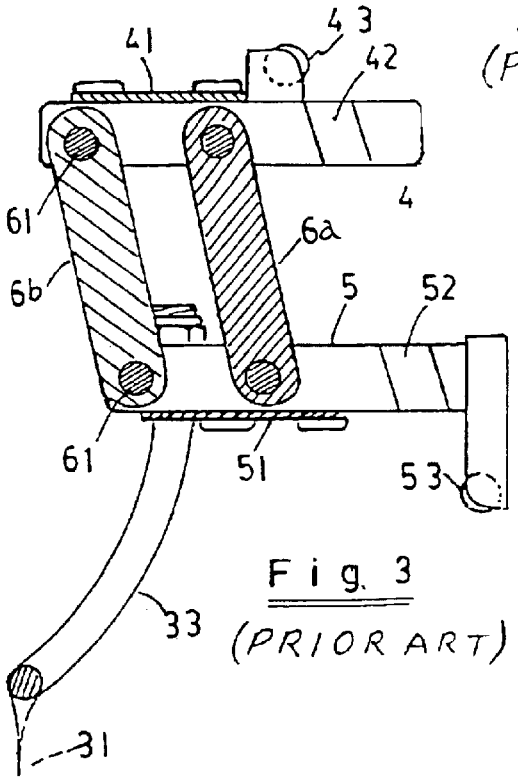
Fig. 3 (PRIOR ART)
Figure 5:
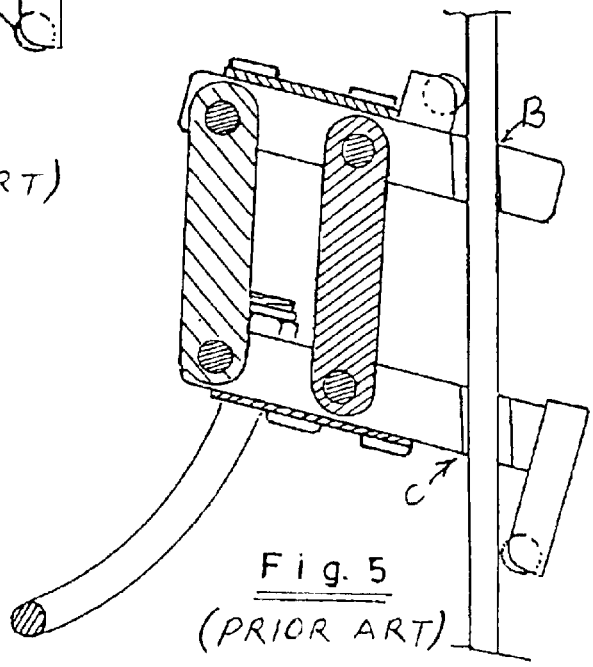
Fig. 5 (PRIOR ART)
FIG. 5 schematically shows a safety device being telescoped into a rail shoulder to proceed with sliding according to the prior art.
Figures 1, 6:
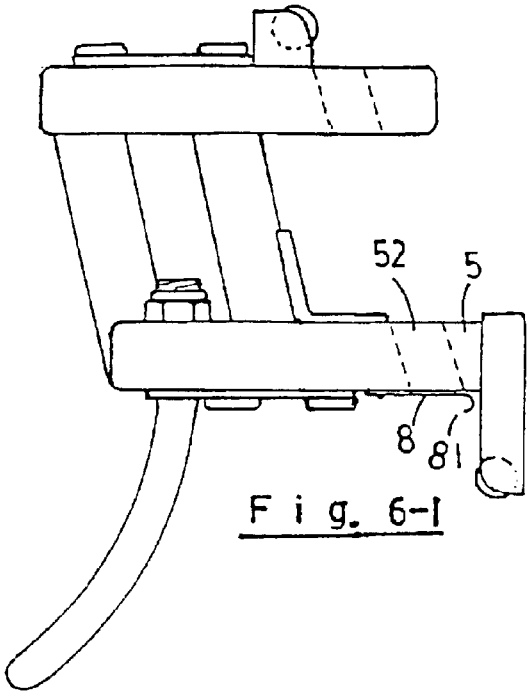
Figures 2, 6:
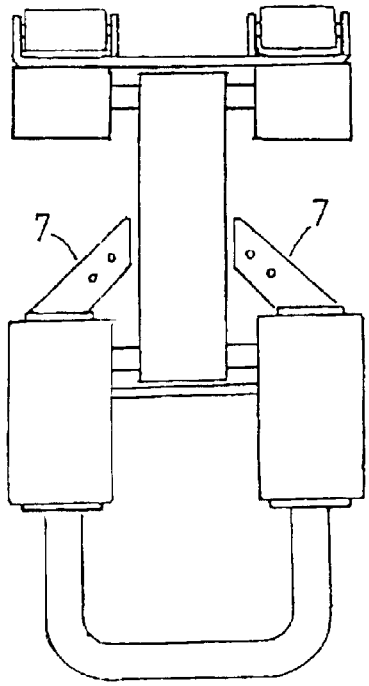
Figures 3, 6:
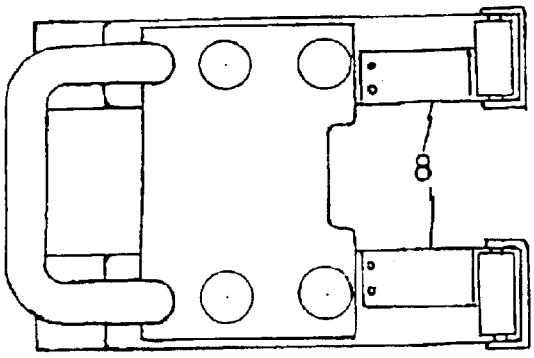

FIGS. 6-1, 6-2 and 6-3 are three side views of the safety device according to the present invention. It can be seen from FIGS. 6-1, 6-2 and 6-3 that the present invention is distinct from the prior art (referring to FIGS. 2 to 5) by that mobile bolts (7) are mounted on the upper end of the lower steel pillar (5), and leaf springs (8) are mounted over the lower slit of the safety groove (52) on the lower steel pillar (5) for preventing the safety device (3) from reverse mounting. As mentioned above, if the conventional safety device for pylon is oppositely telescoped into the safety rail (2), the safety device will be deprived of the safeguard function against risk. According to the present invention, the leaf spring (8) is thin and abundant in elasticity. Because the leaf spring (8) covers the lower slit of the safety groove, it can prevent the safety device from reverse mounting by telescoping upwards into the lower end of safety groove. While mounting the safety device in a forward direction into the safety groove, the leaf springs (8) will subject to the pressure from the side of the rail shoulder (23) to stay close to the safety rail without affecting the sliding of the safety device. The tail end (81) of the leaf spring (8) is formed in the shape of a raised semicircle that is used to eliminate the resistance generated by being propped against the safety rail.

Figure 7:
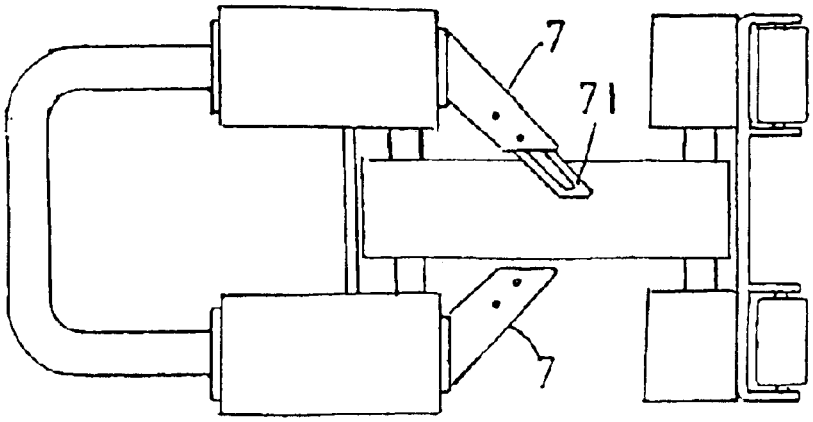
FIG. 7 is a schematic view showing that the tongue of the mobile bolt automatically stretches out to prop against the connection rod while the safety device is transversely shifting according to the present invention.
Figures 1, 8:
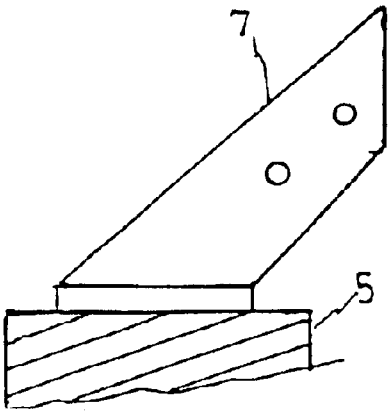
Figures 2, 8:
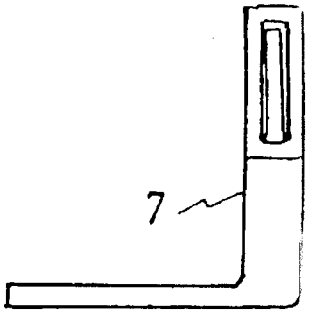
Figures 3, 8:
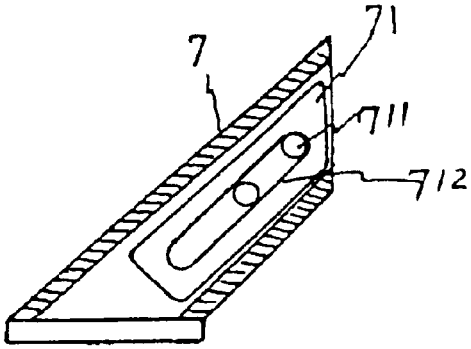

FIG. 7 is a schematic view showing that the tongue (71) of the mobile bolt (7) automatically stretches out to prop against the connection rod while the safety device is transversely shifting according to the present invention, and FIGS. 8-1, 8-2 and 8-3 are enlarged view showing the structure of the mobile bolt (7) according to the present invention. It can be seen from FIGS. 6-1, 6-2 and 6-3 that the two mobile bolts (7) are affixed to the upper end of the lower steel pillar (5), wherein the two mobile bolts (7) are respectively inclined inwards with 45 degrees. The mobile bolt (7) is sheath in shape, as shown in FIGS. 8-1, 8-2 and 8-3, and has a central tongue (71) comprising a groove (712) and short pillars (711) in its center. As a result, the tongue can freely expand and contract to a limited extent. When the safety device (3) is shifting in parallel, the tongues (71) of the mobile bolt (7) will automatically stretch out to prop against the connection rod **(6*a*) due to gravity, so that the upper frame and the lower frame of the safety device will not generate relative motion. Even if the safety belt (31) is employed to pull the safety device, no resistance will be encountered regardless of forward sliding or backward sliding. If the safety device restores to slide in a vertical direction, the tongues (71) of the two mobile bolts (7) will draw back into the mobile bolts (7)**, and the relative motion of the upper frame and the lower frame of the safety device will not be affected.

Although the present invention has been described and illustrated in detail, it is to be clearly understood that the same is by the way of illustration and example only and is not to be taken by way of limitation, the spirit and scope of the present invention being limited only by the terms of the appended claims.

What is claimed is:

1. A safety device for a pylon comprising:

an upper frame including two parallel short steel pillars fixedly connected together by a thick steel piece, a plurality of oblique safety grooves are respectively mounted on an inner side of said two steel pillars and a plurality of rollers are mounted inside slits of said safety grooves; and a lower frame including two parallel short steel pillars fixedly connected together by a thick steel piece, a plurality of oblique safety grooves are respectively mounted on an inner side of said two steel pillars of the lower frame and a plurality of rollers are mounted outside slits of said safety grooves of the lower frame, a leaf spring having a raised end is mounted to cover the slits of said safety grooves of the lower frame, and a plurality of mobile bolts being inclined inwards are respectively mounted on an upper end of said two steel pillars of the lower frame, and each of the mobile bolts comprises a sheath and a tongue, and each of said tongues are enabled to freely expand and contract to a limited extent;

wherein said upper frame and said lower frame are connected through two parallel connecting rods being connected together through a transverse axle to enable said upper frame and said lower frame to make a relative motion.

* * * * *